US005294797A

United States Patent [19]

Frey et al.

[11] Patent Number: 5,294,797

[45] Date of Patent: Mar. 15, 1994

[54] METHOD AND APPARATUS FOR GENERATING IONS FROM THERMALLY UNSTABLE, NON-VOLATILE, LARGE MOLECULES, PARTICULARLY FOR A MASS SPECTROMETER SUCH AS A TIME-OF-FLIGHT MASS SPECTROMETER

[75] Inventors: Ruediger Frey, Weyhe; Armin Holle, Oyten; Gerhard Weiss, Weyhe, all of Fed. Rep. of Germany

[73] Assignee: Bruker-Franzen Analytik GmbH, Fed. Rep. of Germany

[21] Appl. No.: 849,886

[22] Filed: Mar. 12, 1992

[30] Foreign Application Priority Data

Mar. 13, 1991 [DE] Fed. Rep. of Germany ..... 4108462
Mar. 13, 1991 [DE] Fed. Rep. of Germany ..... 4108463

[51] Int. Cl.[5] ..... H01J 49/14

[52] U.S. Cl. ..... 250/427; 250/288; 250/286; 250/287

[58] Field of Search ..... 250/288, 427, 286, 287

[56] References Cited

U.S. PATENT DOCUMENTS

| | | | |
|---|---|---|---|
| 3,182,190 | 5/1965 | Lilly, Jr. et al. | 250/427 |
| 3,296,434 | 1/1967 | Studier | 250/287 |
| 4,570,066 | 2/1986 | Schlag et al. | 250/288 |
| 5,032,722 | 7/1991 | Boesl et al. | 250/286 |
| 5,146,088 | 9/1992 | Kingham et al. | 250/288 |

FOREIGN PATENT DOCUMENTS

| | | |
|---|---|---|
| 873765 | 4/1953 | Fed. Rep. of Germany . |
| 3619886 | 12/1986 | Fed. Rep. of Germany . |
| 3809504 | 9/1989 | Fed. Rep. of Germany . |

OTHER PUBLICATIONS

"Die Multiphotonen-Ionisations (MUPI)-Massenspektrometrie" Angewandte Chemie, 100. Jahrgang 1988, Heft 4, Seite 461-610 (pp. 461-474).

*Primary Examiner*—Jack I. Berman
*Attorney, Agent, or Firm*—Hill, Steadman & Simpson

[57] ABSTRACT

Method for generating ions from thermally unstable, non-volatile, large molecules, particularly for a mass spectrometer such as a time-of-flight mass spectrometer. A specimen substance comprising the molecule is exposed to energy pulses with which molecules are released from the specimen substance, and the released molecules are entrained by a jet of a carrier gas and are cooled upon expansion thereof and are subsequently ionized in an ionization chamber. The molecules are ionized by electron impact, the power per unit area of the electrons employed for the ionization is selected such that a potential trough is generated in the focus of the electron beam, the depth thereof being greater than the translational energy of the molecule ions in the carrier gas stream. The molecule ions generated by the electron impact ionization are respectively collected in the potential trough for a defined time span. The molecule ions respectively collected in the potential trough are accelerated out of the ionization chamber in pulsed fashion. The invention is also directed to an apparatus particularly for the implementation of this method.

27 Claims, 6 Drawing Sheets

Fig. 8A
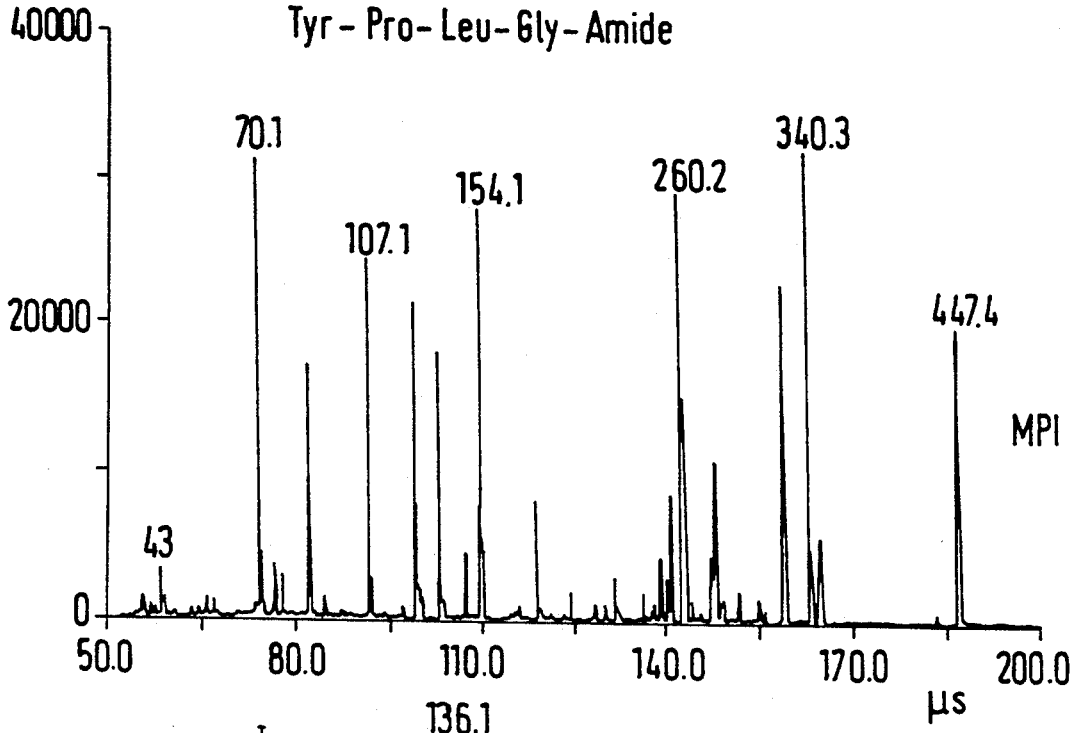
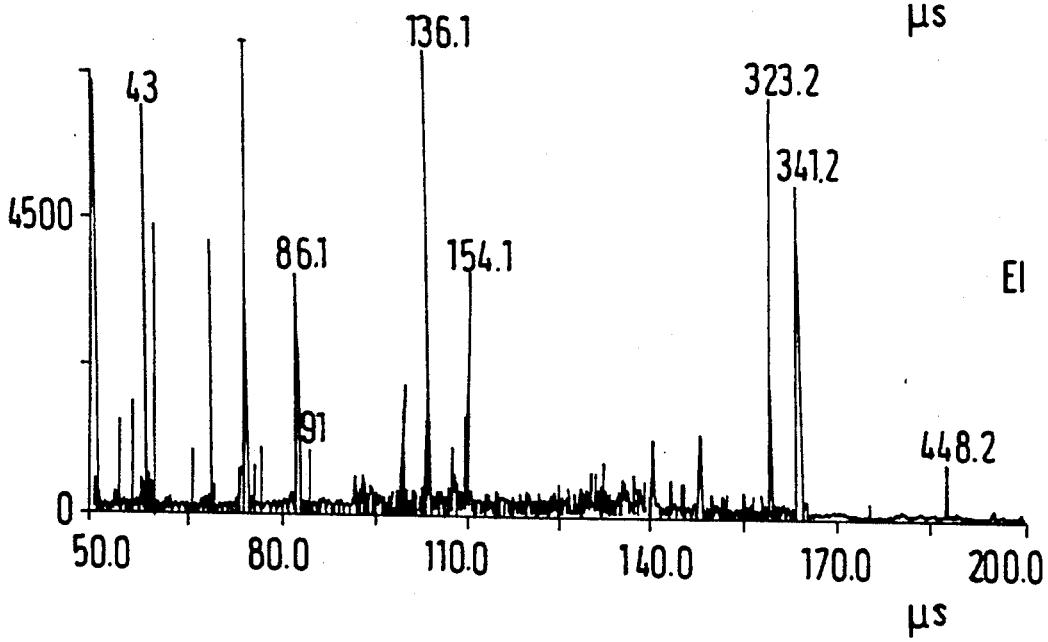
Fig. 8B

METHOD AND APPARATUS FOR GENERATING IONS FROM THERMALLY UNSTABLE, NON-VOLATILE, LARGE MOLECULES, PARTICULARLY FOR A MASS SPECTROMETER SUCH AS A TIME-OF-FLIGHT MASS SPECTROMETER

BACKGROUND OF THE INVENTION

The invention is directed to a method for generating ions from thermally unstable, non-volatile, large molecules, particularly for a mass spectrometer such as a time-of-flight mass spectrometer, whereby a specimen substance comprising the molecules is exposed to energy pulses by which molecules are released from the specimen substance, and whereby the released molecules are entrained by a jet of a carrier gas and are cooled upon expansion thereof and are subsequently ionized in an ionization chamber. The invention is also directed to an apparatus for generating ions from thermally unstable non-volatile, large molecules, particularly for a mass spectrometer such as a time-of-flight mass spectrometer, comprising a means for generating a carrier gas jet, an energy source for the desorbtion of molecules from the specimen material and comprising a means for introducing specimen material into the carrier gas jet, particularly for the implementation of the above-recited method.

German Letters Patent 38 00 504 discloses a method of the species wherein the desorbtion of the molecules ensues with a laser beam. It serves the purpose of converting, in particular, large molecules into the vapor phase before the molecules are brought by a subsequently implemented ionization process into a chemical condition wherein they become accessible for mass spectrometric analysis. What is thereby exploited is that the inner energy absorbed by the molecules due to the desorbtion is greatly reduced in the carrier gas jet, so that the molecules are intensively cooled and their thermal decomposition is largely prevented. This desorbtion process is suitable for liquid and solid specimen substances, whereby it has proven beneficial to accommodate the molecules of the specimen substance in a matrix that thermalitically decomposes easily.

An apparatus with this desorbtion process can be implemented is described in the periodical "ANGEWANDTE CHEMIE" 1988, pages 461 ff, in the overview article "Die Multiphotonen-Ionisation (MUPI) Massenspektrometrie". The specimen substance is thereby placed in front of the orifice of a nozzle from which the carrier gas emerges. By employing infrared laser light, the molecules of the specimen substance are desorbed into the expanding jet of the carrier gas. The inner degrees of freedom of the molecules are thereby cooled and the molecules are farther-conveyed by the carrier gas jet. This apparatus is usually operated as a pulsed system that is composed of a pulsed valve for producing the carrier gas jet and of a laser for the desorbtion of the neutral molecules. Since the molecules are farther-transported as a jet or, respectively, as a particle packet in pulsed mode, it is possible to keep this desorbtion process spatially separated from an ionization process that follows thereafter.

Single-photon or multi-photon ionization has proven itself for the mass-spectrometric examination of the large molecules under consideration. Since the wavelength of the beamed-in photons can be tuned to the energy difference between the basic condition and an excited condition of the neutral molecule, it is possible to undertake the ionization selectively vis-a-vis only the molecules under examination; the carrier gas particles thereby remain in a neutral condition and do not influence the subsequent examination results.

Although multi-photon ionization mass spectrometry is successfully carried out it can nonetheless not be employed for some problems since an only selective excitation of the neutral molecules can often not supply adequate information for the desired structural clarification of the molecule because the excitation wavelength to be selected can not be adequately predetermined given unknown molecules. It has also turned out that some substances can only be ionized with difficulty in the way set forth.

Ionization methods that act non-selectively are known. These include electron impact ionization. Such methods, however, cannot be employed for large molecules are in the present case since they lead to a great fragmentation of the molecule. Moreover, the carrier gas particles are also ionized, this leading to saturation effects, electrostatic repulsion and, thus, to poor resolution and inadequate sensitivity of the analysis. Such influences cannot be left out of consideration for the very reason that the carrier gas particles are present in a concentration that is at least a thousand-fold higher when compared to the molecules to be examined.

The employment of electron impact ionization is disclosed by German Letters Patent 873 765; the combination of this procedure with a method as known from German Published Application 36 19 886, however, only leads to highly fragmented ions in the low mass range, so that large, thermally unstable, non-volatile molecules such as, for example, peptides can thus not be examined therewith.

SUMMARY OF THE INVENTION

The object of the invention is to improve a method of mass spectrometry to the affect that ions from thermally unstable, non-volatile, large molecules can be offered, whereby a non-selective ionization method can be utilized.

According to the present invention, this object is inventively achieved in that the molecules are ionized by electron impact; in that a power per unit area of the electrons employed for the ionization is selected such that a potential trough whose depth is greater than the translation energy of the molecule ions in the carrier gas stream is produced in the focus of the electron beam; in that the molecule ions generated by the electron impact ionization are collected in the potential trough for a respective, defined time span; and in that the molecule ions respectively collected in the potential trough are pulse accelerated out of the ionization chamber.

As an exemplary embodiment of the method the energy of the ionizing electrons is selected lower than would be necessary for the ionization of the carrier gas. Advantageously, helium and/or neon is/are employed as the carrier gas. Additionally, the energy pulses employed for releasing the molecules from the specimen substance are light pulses generated with a laser. Alternatively, the energy pulses employed for releasing the molecules from the specimen substance are applied by a bombardment with ions or neutral particles. The molecules to be ionized can be optionally ionized by electron impact or by photon excitation in one and the same ionization chamber, whereby the electrons and/or the photons are applied pulsed. As part of the inventive arrangement, the specimen molecules can be supplied in pulsed fashion. Additionally, the outward acceleration of the molecule ions collected in the potential trough ensues pulsed in the same rhythm as electron impact and photon ionization. A multi-photon excitation can be employed.

The apparatus of the invention is characterized in that an ionization chamber is provided that comprises an entry opening and an exit opening for a particle beam, whereby an electron source is arranged such that the electron beam generated therewith is focused onto the orbit of the particle beam inside the ionization chamber; in that the apparatus for generating the carrier gas jet comprises an exit opening for the carrier gas jet; and in that a specimen carrier on which the specimen material is applied is arranged in the proximity of the exit opening.

The apparatus can provide an electron source and a photon source optionally operable for ionization of the gaseous specimen inside the ionization chamber. The electron source and photon source for ionization of the gaseous specimen can be optionally operated alternately inside the ionization chamber. Advantageously, the electron beam emitted by the electron source and the photon beam emitted by the photon source are focused on essentially the same region of the ionization chamber. Alternately, the electron beam emitted by the electron source and the photon beam emitted by the photon source are focused onto regions of the ionization chamber that neighbor one another. Advantageously, the ionization chamber is applied to positive potential and comprises a separately chargeable terminating plate. Advantageously, the electron source and/or the photon source can be operated in pulsed fashion. The terminating plate can be switchable in the same rhythm with the electron impact ionization and the photon excitation ionization.

The invention is based on the surprising perception that, contrary to the widespread prejudice of the technical field, the invention succeeds in also ionizing unstable molecules with energy impact, whereby this possibility is created in that the "jet" that is generated produces such a cooling of the heavy molecules (that are to be ionized thereafter) that thereby execute only extremely slight relative motions inside the jet so that they do not decompose during the electron impact ionization. The additional measure of the pulsed withdrawal of the ionized molecules that is enabled by producing the potential trough of variable depth promotes documentation sensitivity in the mass spectrometer and, thus, resolution in a way advantageous to the invention.

In the invention, thus, the molecules are ionized by electron impact, whereby helium and/or neon is/are preferably employed as carrier gas; the energy of the electrons in the electron beam, naturally, thereby preferably lies under the ionization energy of the carrier gas.

All of the advantages of the known technique of laser evaporation with subsequent cooling can be utilized with the method of the invention in order to investigate thermally unstable, non-volatile molecules that were otherwise not accessible to such analytical methods. Since the inner energies of the molecules are considerably reduced by the cooling, the subsequent electron impact ionization also leads to fewer fragments then are usually anticipated. The advantages of the spatial separation of evaporation and ionization can be retained: flexibility in the design of desorbtion and ionization system without the necessity of structural compromises; no contamination of the ion source by desorbed specimen material; ions formed in the desorbtion (by contrast to neutral specimen molecules) do not reach the ion source, whereby good yields can be achieved. By employing inert gases, helium or neon, as the carrier gas, the creation of carrier gas ions is prevented or is at least more greatly suppressed. Both inert gases have an extremely high ionization potential (24.6 eV and, respectively, 21.6 eV), so that they are practically not ionized given electron energies below these ionization potentials, as preferably employed. The molecules to be investigated and having an ionization potential on the order of magnitude of approximately 10 eV, by contrast, are already ionized extremely well at the said electron energies.

A mass spectrometric documentation method that utilizes the pulsed structure of the ion generation is time-of-flight (TOF) mass spectrometry. A time-of-flight mass spectrometer has the fundamental advantage that a complete mass spectrum is registered with every pulse. Over and above, this time-of-flight mass spectrometry has a physical property that makes it especially suitable for the investigation of large molecules. The resolution, namely, increases with increasing mass.

However, a good resolution in the investigation of molecule ions with a time-of-flight mass spectrometer can also only be achieved when the molecule ions start at an optimally exactly defined time ($t<5$ ns) on an optimally small space ($<1$ mm). In general, it is therefore not possible to utilize the entire specimen contained in a gas jet.

It has been shown, however, that the sensitivity of the arrangement can be enhanced when the power per unit area of the electrons employed for the ionization is selected such that a potential trough is produced in the focus of the beam. The neutral molecules to be investigated fly into the focus of the electron beam, are ionized there, but can then—in the ionized condition—no longer depart the focus. They are thus collected in a spatially limited volume over a relatively long time span up to 100 $\mu$s. The ionized molecules collected in this way can be respectively withdrawn as a "packet" having an exactly defined starting time, whereby the terminating plate is switched to 0 V, for example 50 ns after the end of the collecting (shut-off of the electron beam) and the ionized molecules are thereby accelerated into the mass spectrometer. As a result of this pulsed "packet transmission", a good yield with high resolution (as standard for laser ionization) given simultaneously high sensitivity (as characteristic of electron impact ionization) can be achieved.

Moreover, light pulses produced with lasers can be employed as energy pulses for the desorbtion; continuously operating lasers are thereby also suitable. The wavelengths that are utilized thereby lie in the range from micrometers down to a few tens of nanometers. The energy pulses can also be exerted by bombardment with ions or neutral particles.

In a specific embodiment of the invention, an ionization of the specimen by electron impact or by photon excitation is optionally implemented in the same ionization chamber. The specimen to be investigated therefore has to be prepared and admitted into the ionization chamber only once and can be subsequently investigated while exploiting the advantages of both ionization methods. It is thus thereby assured that one and the same specimen is investigated with both measuring methods. It is thereby advantageous when the photon beam is pulsed and when the gaseous specimen is also supplied in pulsed fashion, whereby the ionization methods must be correspondingly switched in synchronized fashion. The switching frequency is thereby limited only by the time required for the registration of the spectrum and the evaluation thereof.

By contrast to the prior art, as stated, an electron source and a photon source are provided for one and the same ionization chamber, these being optionally operable for ionization of the gaseous specimen inside the ionization chamber, whereby the ionization preferably ensues pulsed. In previously known apparatus, the photon ionization was implemented in a constant electrical field, whereby the necessary, precisely defined starting time of the ions was defined by chronologically correspondingly dimensioned laser pulses. Such a procedure is inexpedient for electron impact ionization. If one would like to unproblematically switch between electron impact ionization and photon ionization, this can only occur in that the photon ionization is not implemented in the standard way but adapted to the apparatus for the electron impact ionization.

It is also important for the switching that the adjustment and, thus, the dimensional calibration of the subsequent mass spectrometer need not be changed. Only in this way can repetition rates on the order of magnitude of 20 Hz be achieved, so that a switch can be undertaken at every pulse packet of molecules to be investigated. In order to achieve this, the ions must be ionized at exactly the comparable time, exactly in the same volume and exactly at the same potential. In addition to the implementation of the ionization within an ionization chamber for the different ionization methods, it is advantageous for this purpose that the electron beam emitted by the electron source and the photon beam emitted by the photon source are focused on essentially the same region of the ionization chamber. When the electron beam and the laser beam are adjustably established, then the required adjustments can be implemented in a relatively simple way during the operation of the apparatus.

As previously stated above, the photon ionization is also implemented under the same conditions as the electron impact ionization. To that end, the ionization chamber is an ionization chamber that is advantageously placed at positive potential whose terminating plate, i.e. the region wherein the ionized molecules depart the ionization chamber, can be separately charged. The starting time for the ions discharged from the ionization chamber can then be defined in that this terminating plate is switched to grounded potential, i.e. to 0 V, within an extremely short time. Of course, it is also possible within the idea of the invention to connect the terminating plate to a potential that differs from 0 V insofar this is merely selected such that it is suitable for accelerating the ions into the mass spectrometer. At the time the terminating plate is switched to the accelerating potential, the ions begin their flight in the acceleration field that has thus arisen into the mass spectrometer that follows the ionization chamber.

According to a preferred embodiment of the invention, electron source and/or photon source—as already set forth—are operated pulsed, so that a time-of-flight mass spectrometer can be utilized as mass spectrometer with which a complete mass spectrum can be registered for every ion packet.

Further features and embodiments of the invention derive from the claims and from the following description wherein exemplary embodiments are set forth in detail with reference to the schematic drawing. Thereby shown are:

BRIEF DESCRIPTION OF THE DRAWINGS

FIGS. 8*a* and *b* are raw data spectra obtained with the apparatus of FIG. 7 for the thermally unstable peptide Trp-Pro-Leu-Gly-amide, whereby both the multiphoton ionization spectrum (MPI) as well as the electron impact ionization spectrum (EI) are shown.

DETAILED DESCRIPTION OF THE PREFERRED EMBODIMENTS

Figure 1:
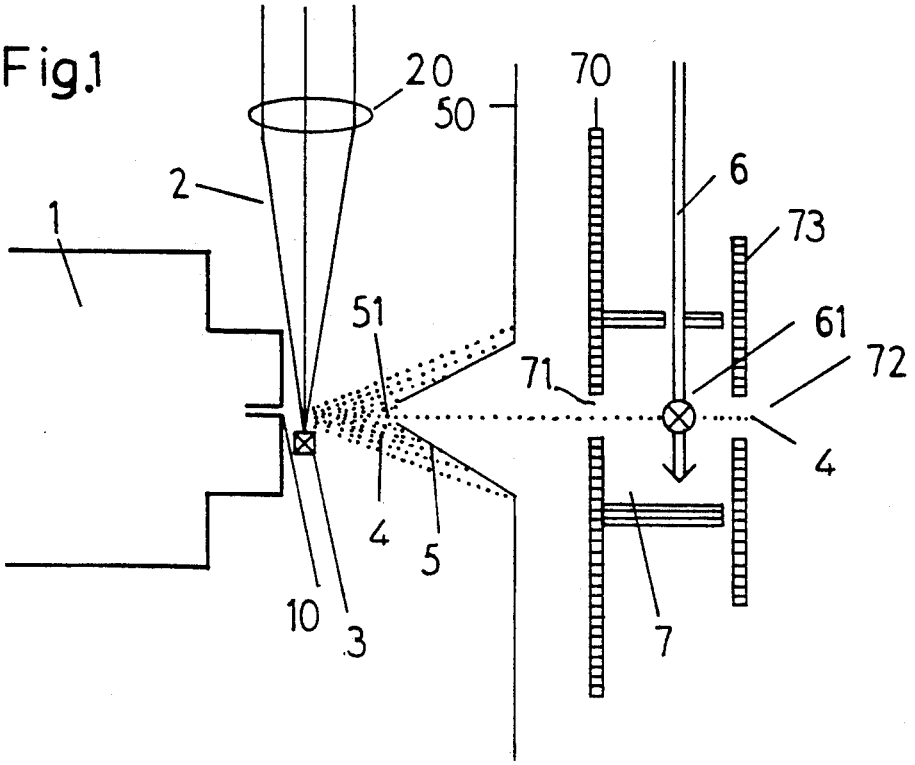
FIG. 1 is a schematic view of a first exemplary embodiment of an apparatus for the implementation of a method of the invention.

The first exemplary embodiment of the apparatus for generating ions from thermally unstable non-volatile, large molecules according to the method of the invention is shown in FIG. 1. An apparatus 1 is provided for generating a carrier gas jet from which the carrier gas jet—controlled by a pulsed valve comprising a nozzle 10—emerges into a vacuum. Given employment of helium as carrier gas, a gas pulse having a length of 1 μs through 10 ms is thereby generated, whereby a pulse length of 500 μs or less is optimum for most purposes. A helium admission pressure of approximately 2 bar is set at a high-pressure side of the valve; it can be fundamentally expedient to keep the pressure between 0.2 bar through 200 bar dependent on the demands. The nozzle 10 has an orifice having a diameter of 0.2 mm that, however, can be varied in the range of sizes from 0.01 through 1 mm. The opening of the valve or, respectively, of the nozzle 10 occurs electromagnetically.

A gas pulse generated in this way can be a supersonic jet. The carrier gas atoms thereby move with approximately the same speed, whereby the relative thermal motion of the atoms is comparatively slight. Consequently, the jet has a low temperature on the order of magnitude of 1K.

A specimen carrier 3 having a specimen applied thereon is situated in the immediate proximity of the orifice of the nozzle 10, this specimen being potentially either solid or liquid, whereby it is also possible to incorporate this specimen into a matrix. Pulsed infrared light such as a photon beam 2 from a suitable light source, for example from a $CO_2$ laser, is beamed onto the specimen carrier 3 or, respectively, onto the specimen situated thereon approximately perpendicularly vis-a-vis the jet emerging from the nozzle 10.

A lens 20 is provided for focusing the photon beam 2. The pulse of this photon beam 2 is chronologically synchronized with the pulse of the carrier gas emerging from the nozzle 10. A suitable pulse length for a $CO_2$ laser having the wavelength of 10.6 μm for the light is 10 μs. As a result of the incident photon beam 2, the material to be investigated is preferably desorbed into the space adjacent the nozzle 10. First, namely, all degrees of freedom of the molecules, namely rotational, vibrational and translational degrees of freedom are excited; the energy contained therein will subsequently cool greatly in the particle beam, the supersonic jet. A decomposition of the thermally unstable molecules is thereby largely prevented.

The molecules desorbed from the specimen carrier 3 are now present in a gaseous condition and the majority part thereof is situated in the carrier gas jet emerging from the nozzle 10. Together with the carrier gas, the molecules are conveyed as particle beam 4 onto a skimmer 5 that only allows the central region of the particle beam 4 to pass through. The part of the particle beam 4 that is skimmed off must be pumped off for vacuum-associated reasons and is thus no longer available for the analysis.

The skimmer 5 is essentially composed of a hollow cone placed onto a planar wall 50 whose tip is fashioned to form an opening 51 whose diameter is selected in accord with the cross section of the particle beam 4 to be gated. What is thus achieved is that a gated particle beam 4' that is nearly precisely aligned in a preselected direction ultimately enters into the ionization region.

The ionization occurs inside an ionization chamber 7. The front wall 70 of the ionization chamber 7 comprises an entry opening 71 through which the gated particle beam 4' enters and which is aligned with the nozzle 10 and the opening 51 of the skimmer 5. A pulsed electron beam 6 is introduced into the ionization chamber 7 perpendicularly impinging the gated particle beam 4', the focus 61 of this electron beam 6 being set such that it lies on the path of the gated particle beam 4'. The electron beam is chronologically pulsed with a length of 10 ns through 100 μs, whereby the pulse is synchronized with the time span during which a particle "packet" flies by. The ionization chamber 7 is at a positive potential over approximately 1,000 V.

The energy of the electrons introduced in the electron beam 6 can be regulated from a few eV up to 100 eV. These electrons then ionize the molecules to be investigated by electron impact. When the energy of the electrons is selected on the order of magnitude of 25 eV, the particles of the carrier gas are not ionized, so that no falsifications of the result in the mass spectrometric analysis later derive.

The intensity per unit area of the electrons is so high that a potential trough or potential sink can build up in the focus 61 of the electron beam 6, this being deep enough in order to catch the ionized molecules, i.e. molecule cations, that initially move with the speed of the particle jet 4' for a short time. The molecule ions to be investigated are thus collected in a spatially limited volume.

The pulse duration of the electron beam 6 is adapted such that the pulse is ended when the collecting is also ended. A few tens of ns later, a terminating plate 73 that closes the ionization chamber 7 is switched to 0 V in less than 5 ns. At this time, the molecule ions begin their flight from the collecting point in the focus 61 to the exit opening 72 in the terminating plate 73 in the arising accelerating field, flying toward the time-of-flight mass spectrometer.

Figure 2:
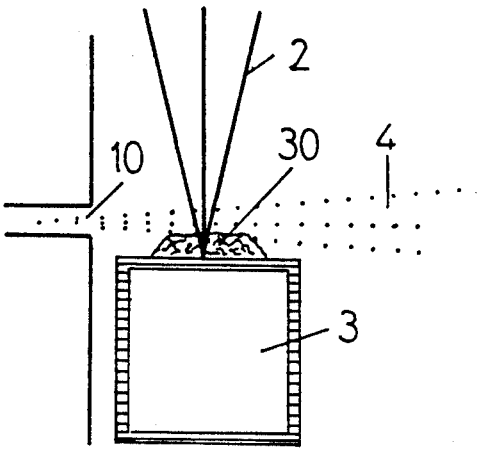
FIG. 2 is an enlarged schematic view of the apparatus of FIG. 1 in the region of a specimen substance to be evaporated.

FIG. 2 shows the space in front of the nozzle 10 of the apparatus for generating a carrier gas jet. The jet 4 emerges from the nozzle 10 as a pulse packet and passes the specimen substance 30 of the molecules to be investigated that is situated on the specimen carrier 3. A photon pulse 2 is beamed in synchronism with the carrier gas pulse packet, this photon pulse 2 effecting the desorbtion of the molecules from the specimen substance or, respectively, from the specimen carrier 3. The molecules diffuse into the particle jet and are borne by the latter in the direction toward the skimmer 5 or, respectively, toward the ionization chamber 7.

Figure 3:
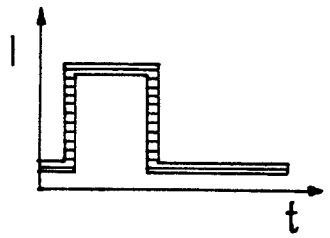
FIG. 3 is an intensity-time diagram for an electron beam employed in the apparatus of FIG. 1.

FIG. 3 shows the intensity-time diagram of the electron beam that effects the ionization of the molecules in the ionization chamber 7. The pulse has steep edges and is kept constant over the time span required for the ionization.

Figure 4:
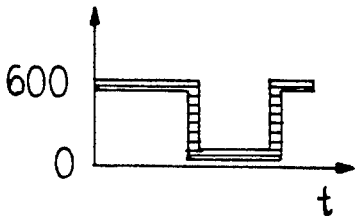
FIG. 4 is a voltage-time diagram for an acceleration plate from the apparatus of FIG. 1.

After the electron beam pulse is shut-off (FIG. 3), the potential of the terminating plate 73 of the Faraday cage, as shown in FIG. 4, is shut off within an extremely short time, so that a pulse having steep edges likewise derives here, this being maintained at 0 V over a time span of, example, 20 μs which is adequate to generate the field required for the acceleration of the molecule ions; of course, the terminating plate can also be connected to some other potentials suitable for the acceleration of the molecule ions instead of being connected to 0 V.

Figure 5:
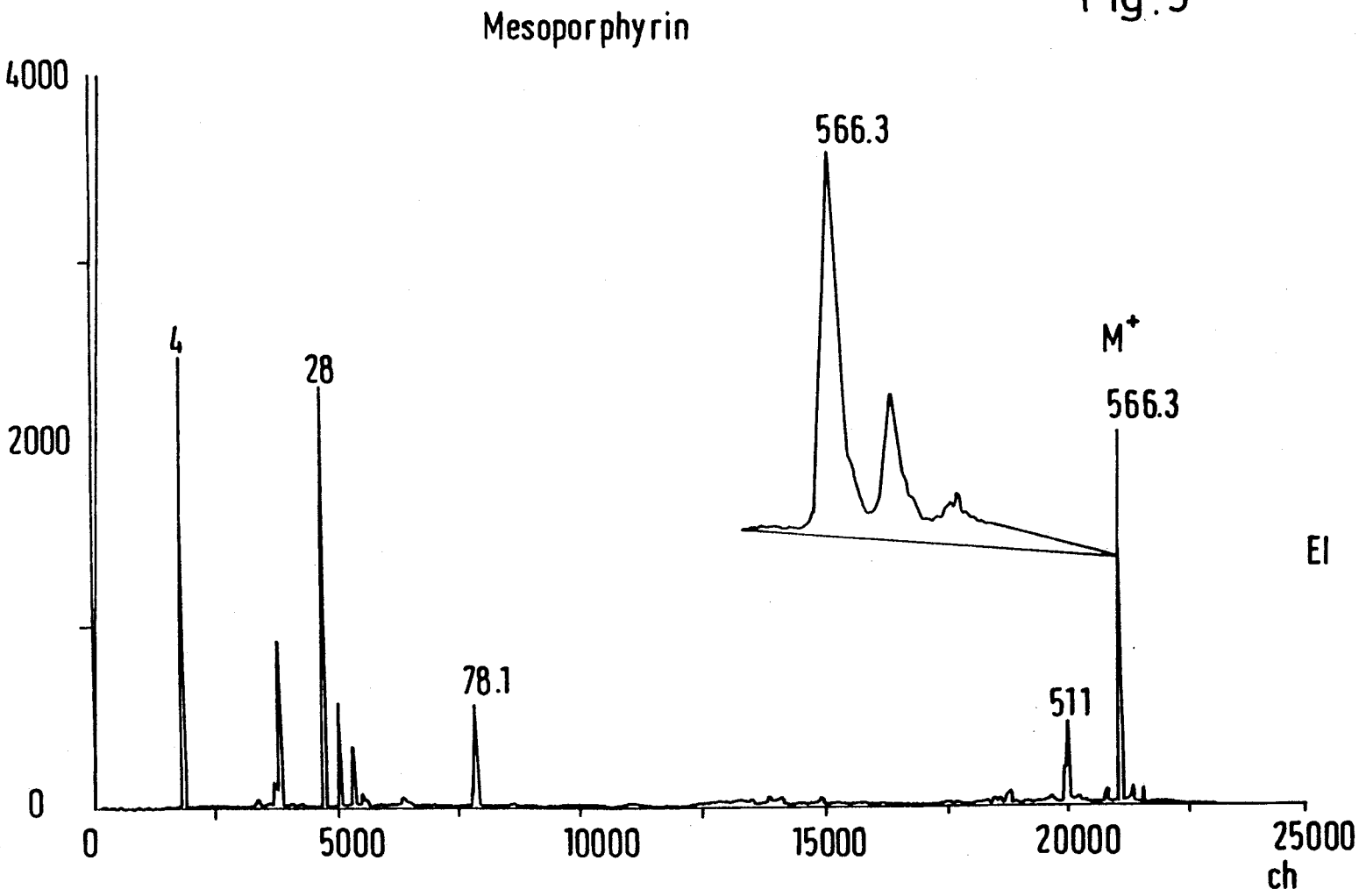
FIG. 5 is a raw data spectrum of the non-volatile substance mesoporphyrine, whereby air and benzene were added to the carrier gas jet (helium) for testing purposes.

FIG. 5 shows a raw data spectrum of the non-volatile substance mesoporphyrine. Air and benzene are thereby added to the carrier gas, helium (having the mass-charge ratio $m/z=4$). These admixtures yield peaks in the region of $m/z=28$ as well as a relatively precisely defined peak at $m/z=78$.

Even though a high proportion of fragments usually occurs in electron impact ionization during which the ionized molecule can usually not be observed, a well-formed peak is obtained here at $m/z=566.3$, the existence thereof being produced by the previously implemented cooling of the molecules to be investigated. The mass spectrum (isotope distribution) in the environment of the molecule ion peak is shown in detail in higher resolution of the same figure.

Figure 6:
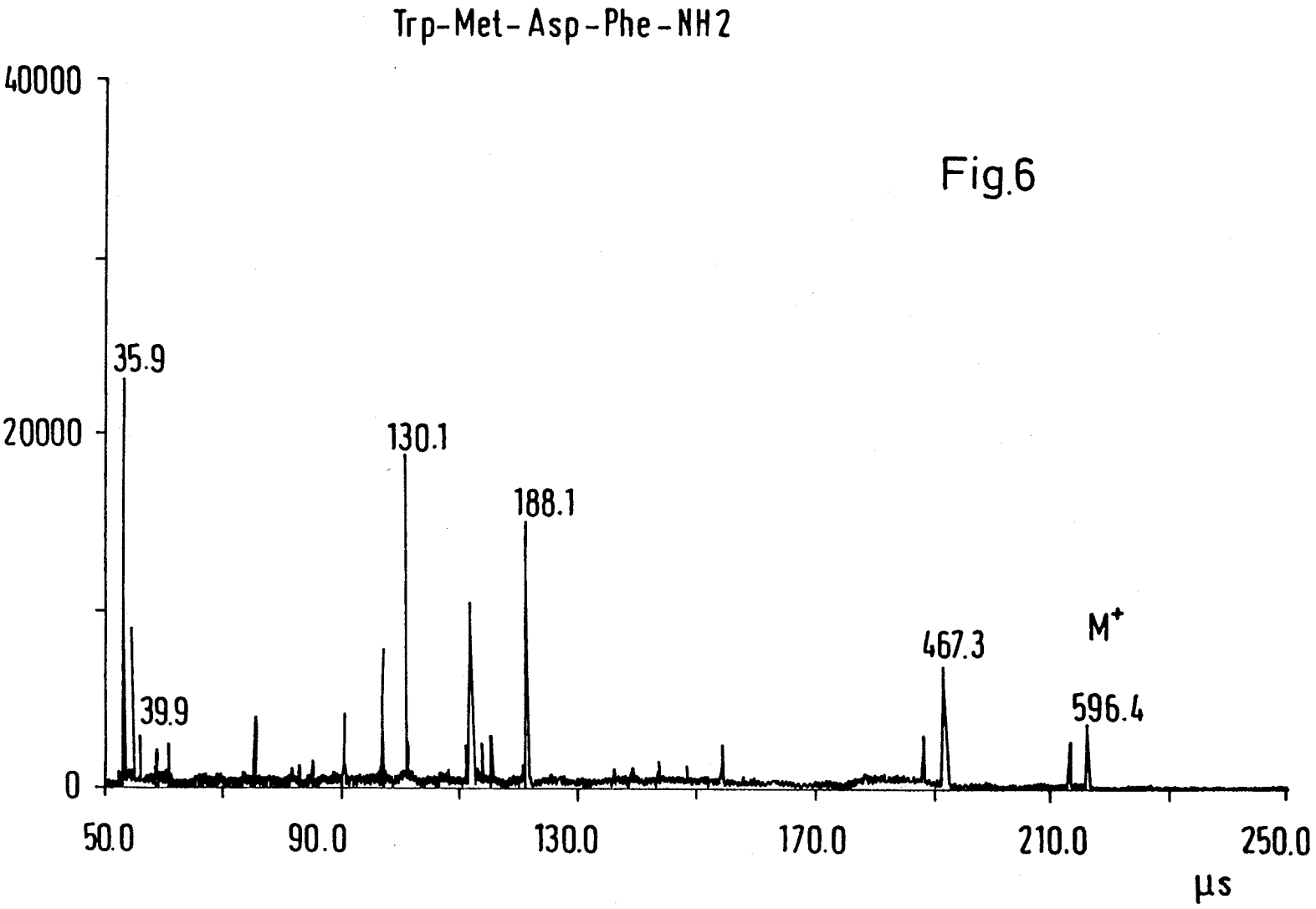
FIG. 6 is the raw data spectrum of the non-volatile, thermally unstable peptide Trp-Met-Asp-Phe-$NH_2$.

FIG. 6 shows a raw data spectrum of the thermally unstable peptide Trp-Met-Asp-Phe-$NH_2$. Here, too, a peak can be found at the corresponding molecule ion ($m/z=596.4$) that never occurred before without the combination of the electron impact ionization with preceding cooling.

Figure 7:
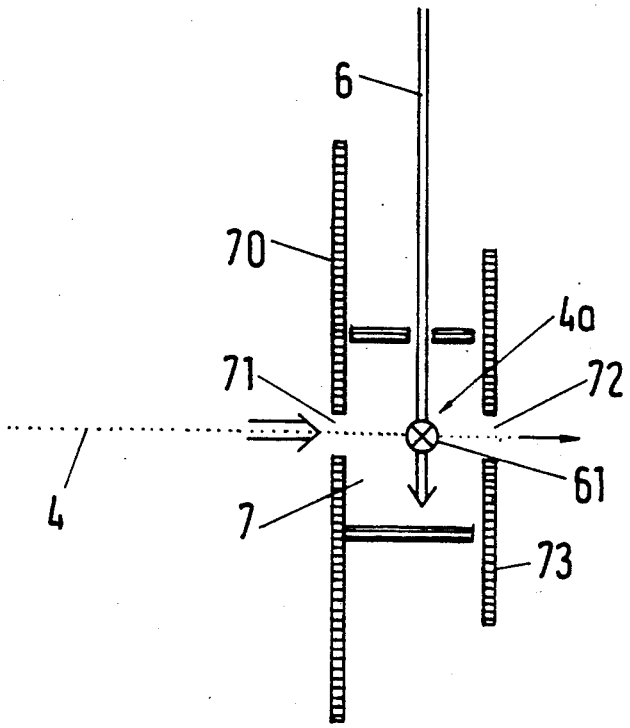
FIG. 7 is a schematic view of a second exemplary embodiment of an apparatus for the implementation of a further embodiment of the method of the invention.

The further exemplary embodiment of the apparatus of the invention shown in FIG. 7 comprises an ionization chamber 7 whose front wall or plate 70 is provided with an entry opening 71 through which the molecules 4 to be investigated can enter in the form of a continuous jet or as a particle packet. A terminating plate 73 that comprises an exit opening 72 aligned with the entry opening 71 is provided lying opposite the front plate 70.

It can be advantageous for some applications when the molecules to be investigated do not flow in on the axis defined by the entry opening 71 and exit opening 72 but proceed into the ionization chamber 7 from all sides by diffusion.

As soon as the molecules to be investigated are situated in the ionization chamber, the ionization process is initiated.

For example, the ionization can first ensue by electron impact. To that end, an electron beam 6 is spatially focused onto the center of the ionization chamber whereby the energy of the electrons can be controlled from a few eV up to 1200 eV.

When the admission of the molecules to be investigated ensues pulsed, the electron beam 6 is also switched in pulsed mode, whereby the pulse duration can amount to from 10 ns through approximately 100 μs.

In order to achieve a good resolution in the investigation of the molecule ions with a time-of-flight mass spectrometer, the molecule ions must start at an optimally exactly defined time ($t<5$ ns) on an optimally small space (<1 mm). In general, it is not possible to observe these conditions and to exploit all of the specimen contained in a gas jet. It has been shown, however, that the sensitivity of the arrangement can be enhanced when the power per unit area of the electrons employed for the ionization is selected such that a potential trough is generated in the focus 61 of the beam. The neutral molecules to be investigated fly into the focus of the electron beam 6, are ionized therein but—in their ionized condition, can no longer leave the focus 61. They are thus collected in a spatially limited volume over a relatively long time span of up to 100 μs.

After the electron impact ionization has been ended, the terminating plate 73 of the ionization chamber 7 is connected to 0 V approximately 10 μs later, whereby this switching occurs in less than 5 ns. The starting pulse for the ions for their flight in the time-of-flight mass spectrometer is thus supplied.

A few μs later, the ionization chamber 7 is again placed at positive potential overall, for example at 600 V. The photon ionization can be subsequently undertaken.

To that end, a pulsed laser beam 4a is beamed into the ionization chamber 1. The laser pulses employed have a typical duration of 5 ns.

Given photon ionization, the brief duration of the laser pulses would cause a precisely defined starting time of the ions by itself, so that the ionization chamber 7 having the separately chargeable terminating plate 73 would not be needed. However, an unproblematical switching between electron impact ionization and photon ionization would not be possible if different spatial arrangements had to be employed for the two ionization methods. It would also be inherently possible to hold the terminating plate at constant potential in the photon ionization, whereby variable potential distributions, however, derive in practice that make a readjustment of the mass spectrometer necessary. The starting pulse for the ionized molecules is therefore also established for the photon ionization by switching the terminating plate 73 to 0 V, this occurring under the same conditions as set forth above in conjunction with the electron impact ionization.

In the apparatus of FIG. 1, the focus of the electron beam 6 and the focus of the photon beam 4a coincide in a region 61 that lies on the path of the molecules to be investigated.

FIG. 8 shows raw data spectra for the thermally unstable peptide Trp-Pro-Leu-Gly-amide. The multiphoton ionization spectrum (MPI) exhibits a well-developed peak at the corresponding molecule ion ($m/z=447.4$) that is less well-defined in the electron impact ionization spectrum (EI). The two spectra compared to one another clearly show that respectively different fragments are obtained in different proportions. Both spectra were registered under exactly the same experimental conditions with the same specimen, whereby the inventive, fast switching between the photon ionization and the electron impact ionization was undertaken. Laser desorbtion in a supersonic jet suitable for thermally unstable molecules was utilized as the admission system.

Figure 9A:
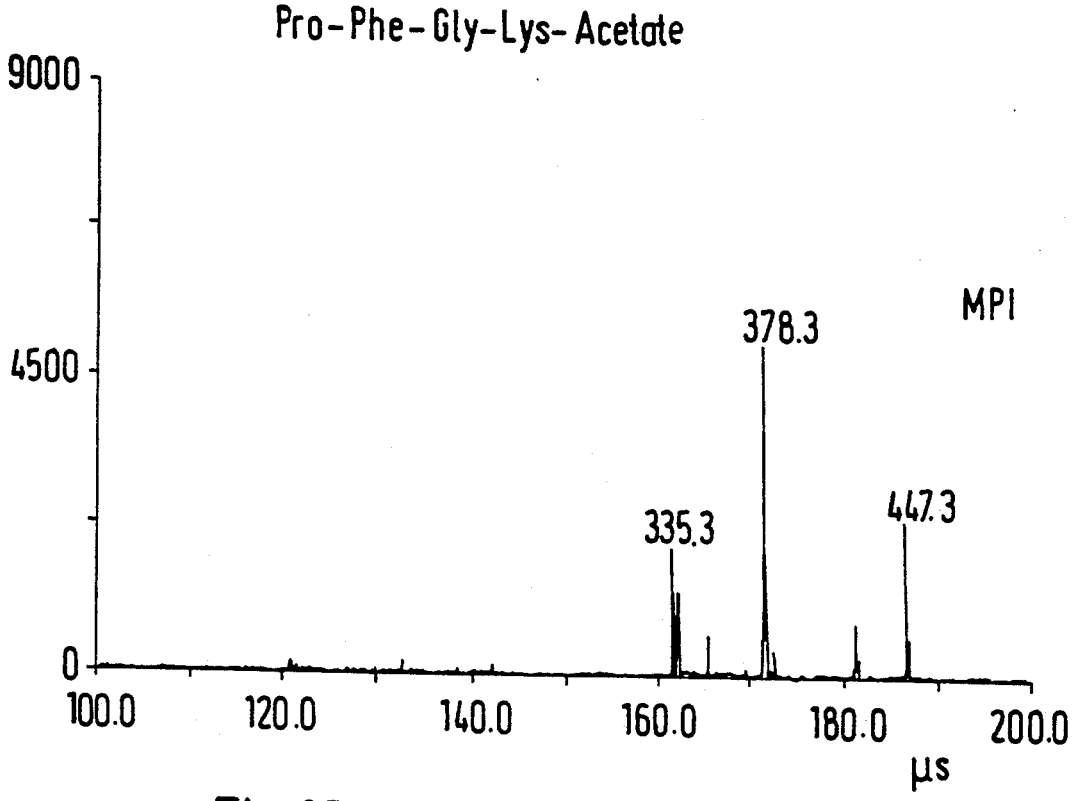
FIGS. 9*a* and *b* are raw data spectra obtained with the apparatus of FIG. 7 from the thermally unstable peptide Pro-Phe-Gly-Lys-acetate, whereby both the multi-photon ionization spectrum (MPI) as well as the electron impact ionization spectrum (EI) are again shown.
Figure 9B:
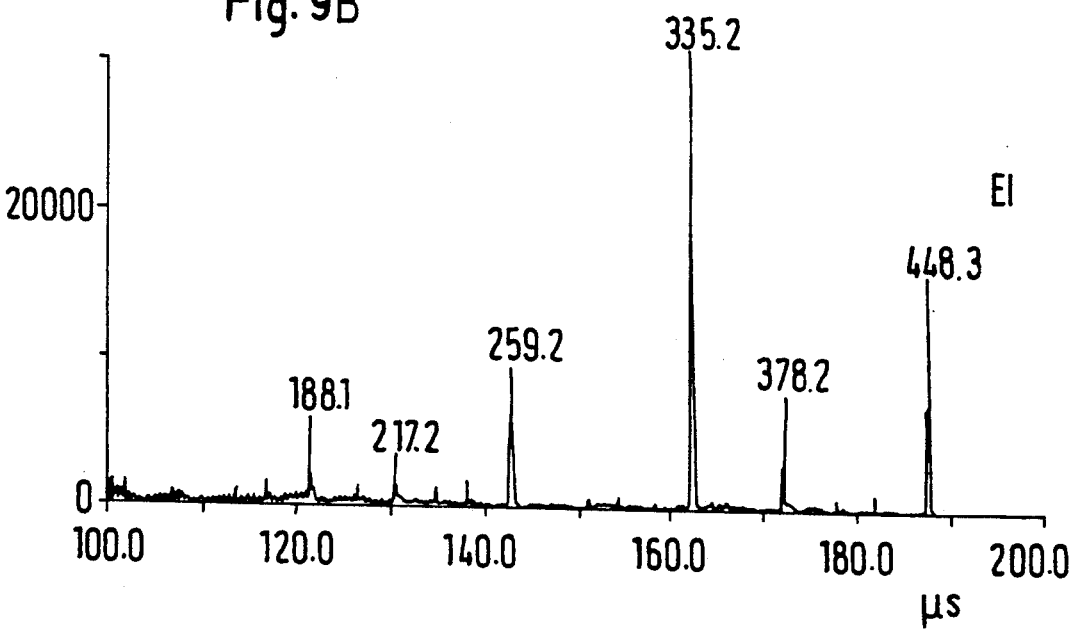

FIG. 9 shows the raw data spectra of Pro-Phe-Gly-Lys-acetate, whereby the spectra were again obtained, first, by multi-photon ionization (MPI) and, second, by electron impact ionization under exactly the same experimental conditions upon employment of the same specimen. Further, rapid switching was undertaken between photon ionization and electron impact ionization. One can see that smaller fragments were obtained with the electron impact ionization, so that it becomes clear precisely here that the two spectra obtained with different ionization methods advantageously supplement one another.

Although the present invention has been described with reference to a specific embodiment, those of skill in the art will recognize that changes may be made thereto without departing from the scope and spirit of the invention as set forth in the appended claims.

The invention claimed is:

1. Method for generating ions from thermally unstable, non-volatile, large molecules, for a mass spectrometer, comprising the steps of:

exposing a specimen substance comprising the molecules to energy pulses by which some of the molecules are released from the specimen substance;

entraining the released molecules by a jet of a carrier gas and cooling the released molecules by expansion of the carrier gas;

ionizing the molecules by electron impact from an electron beam, focused onto a path of the molecules at a focus, in an ionization chamber;

selecting the power per unit area of the electrons employed for the ionization such that a potential trough is produced in the focus of the electron beam, the depth thereof being greater than the translational energy of the molecule ions in the carrier gas stream;

collecting the molecule ions generated by the electron impact ionization for a respectively defined time span in the potential trough; and accelerating the molecule ions respectively collected in the potential trough out of the ionization chamber in pulsed fashion.

2. Method according to claim 1, comprising the further step of selecting the energy of the ionizing electrons lower than would be necessary for the ionization of the carrier gas.

3. Method according to claim 1, comprising the further step of employing helium as carrier gas.

4. Method according to claim 1, comprising the further step of employing neon as carrier gas.

5. Method according to claim 1, wherein the energy pulses employed for releasing the molecules from the specimen substance are light pulses generated with a laser.

6. Method according to claim 1, wherein the energy pulses employed for releasing the molecules from the specimen substance are applied by bombardment with ions or neutral particles.

7. Method according to claim 1 comprising the further step of ionizing the molecules by photon excitation in the ionization chamber, whereby the electrons and the photons are applied pulsed.

8. Method according to claim 7, wherein the specimen molecules are supplied pulsed.

9. Method according to claim 7, wherein the outward acceleration of the molecule ions collected in the potential trough ensues pulsed in synchronism with the electron impact ionization and photon excitation ionization.

10. Method according to one of the claim 7, wherein a multi-photon excitation is employed.

11. Apparatus for generating ions from thermally unstable, non-volatile, large molecules, for a a time-of-flight mass spectrometer, comprising:

a means for generating a carrier gas jet having an exit opening for delivering the carrier gas jet;

a specimen carrier on which a specimen material is applied, arranged in the proximity of the exit opening;

an energy source for the desorbtion of molecules from the specimen material;

a means for introducing specimen material into the carrier gas jet;

a means for gating the carrier gas jet with specimen material introduced therein into a particle beam;

an ionization chamber having an entry opening and an exit opening for the particle beam; and an electron source arranged such that the electron beam produced by said electron source is focused onto the path of the particle beam inside the ionization chamber.

12. Apparatus according to claim 11 further comprising a photon source, the electron source and the photon source being optionally operable for ionization of the gaseous specimen inside the ionization chamber.

13. Apparatus according to claim 12, wherein the electron source and the photon source for ionization of the specimen have timing means for selectively operating alternately inside the ionization chamber to analyze the same specimen.

14. Apparatus according to claim 12, wherein the electron beam emitted by the electron source and the photon beam emitted by the photon source are focused on essentially the same region of the ionization chamber.

15. Apparatus according to claim 12, wherein the electron beam emitted by the electron source and the photon beam emitted by the photon source are focused onto regions of the ionization chamber that neighbor one another.

16. Apparatus according to claim 12, wherein the ionization chamber is applied to positive potential and comprises a separately chargeable terminating plate.

17. Apparatus according to claim 16, wherein the terminating plate is switchable in synchrony with the electron impact ionization and photon excitation ionization.

18. Apparatus according to claim 12, wherein the electron source is operatable in pulsed fashion.

19. Apparatus according to claim 12, wherein the photon source is operable in pulsed fashion.

20. Apparatus for generating ions from thermally unstable, non-volatile, large molecules, for a mass spectrometer, comprising:

a means for generating a jet of carrier gas, the means for generating having an exit opening for delivering the jet;

a specimen carrier on which a specimen material is applied arranged in the proximity of the exit opening;

an energy source for the desorbtion of molecules from the specimen material;

a means for introducing specimen material into the carrier gas jet creating a mixture of carrier gas and specimen material;

an ionization chamber having an entry opening for passage of the mixture therein and an exit opening for passage of the mixture thereout;

an electron source arranged such that the electron beam produced by said electron source is focused onto the path of the mixture inside the ionization chamber; and a photon source arranged to focus a photon beam onto the path of the mixture inside the ionization chamber both said electron source and said photon source being used to ionize the mixture for analysis.

21. Apparatus according to claim 20, wherein the electron source and the photon source for ionization of the mixture are selectively operable rapidly alternately inside the ionization chamber.

22. Apparatus according to claim 20, wherein the electron beam emitted by the electron source and the photon beam emitted by the photon source are focused on essentially the same region of the ionization chamber.

23. Apparatus according to claim 20, wherein the electron beam emitted by the electron source and the photon beam emitted by the photon source are focused onto regions of the ionization chamber that neighbor one another.

24. Apparatus according to claim 20, wherein the ionization chamber is applied to positive potential and comprises a separately chargeable terminating plate.

25. Apparatus according to claim 24, wherein the terminating plate is switchable in synchrony with electron impact ionization from the electron source and photon excitation ionization from the photon source.

26. Apparatus according to claim 20, wherein the electron source is operatable in pulsed fashion.

27. Apparatus according to claim 20, wherein the photon source is operable in pulsed fashion.

* * * * *